United States Patent [19]

Bayles et al.

[11] 3,991,290

[45] Nov. 9, 1976

[54] ANTI-ROCK PREVENTING MEANS FOR ELECTRIC SWITCH CONTACTS

[75] Inventors: John E. Bayles, East Dover, Vt.; Randall C. Bremer, East Granby, Conn.; George E. Gauthier, Farmington, Conn.; Frank J. Nascimbeni, Avon, Conn.; Robert J. Petitjean, Simsbury, Conn.

[73] Assignee: Arrow-Hart, Inc., Hartford, Conn.

[22] Filed: Jan. 10, 1975

[21] Appl. No.: 540,003

Related U.S. Application Data

[62] Division of Ser. No. 347,460, April 4, 1973, Pat. No. 3,887,888.

[52] U.S. Cl. ..... 200/250

[51] Int. Cl.[2] ..... H01H 1/50

[58] Field of Search ..... 200/250, 251, 153 SC, 200/159 A, 163, 282, 283, 290

[56] References Cited

UNITED STATES PATENTS 2,059,702 11/1936 Matthias ..... 200/250

3,104,302 9/1963 Williams ..... 200/250

*Primary Examiner*—Herman Hohauser

*Attorney, Agent, or Firm*—Davis, Hoxie, Faithfull & Hapgood

[57] ABSTRACT

An electric switch of the sort capable of carrying high amperage currents, especially under short circuit conditions is provided with a ferromagnetic U-shaped yoke piece around the contacts and an armature mounted on the movable contact carrier in position to be attracted by the magnetic force created in the yoke when current flows through the contacts. The fixed and movable contact members act like a one-turn electromagnetic coil especially under severe short circuit conditions to hold the contacts together against electromagnetic forces which otherwise would cause contact separation under such conditions. Rocking of the movable contact on the fixed contact is prevented by a leaf spring which acts in closed circuit position of the contacts and in cooperation with the holding means on short circuit conditions.

3 Claims, 6 Drawing Figures

FIG.1
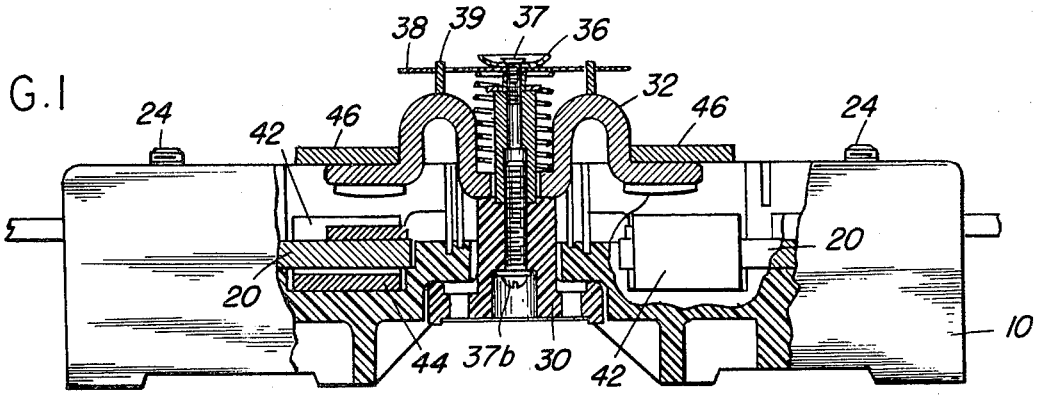
FIG.2
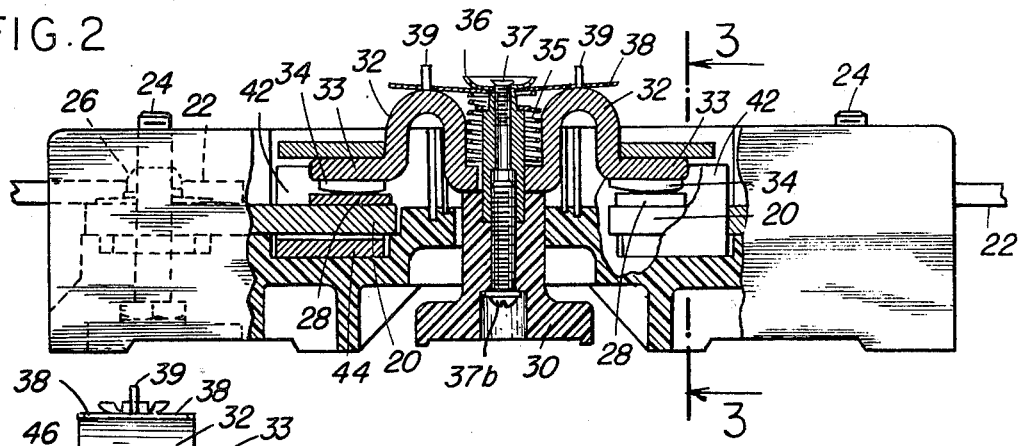
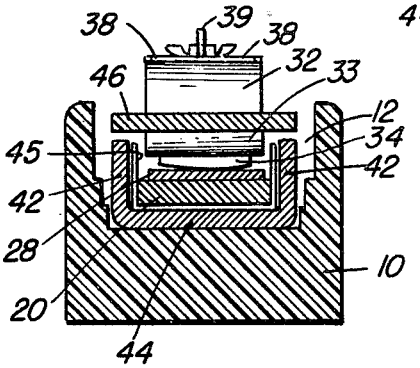
FIG.3
FIG.4
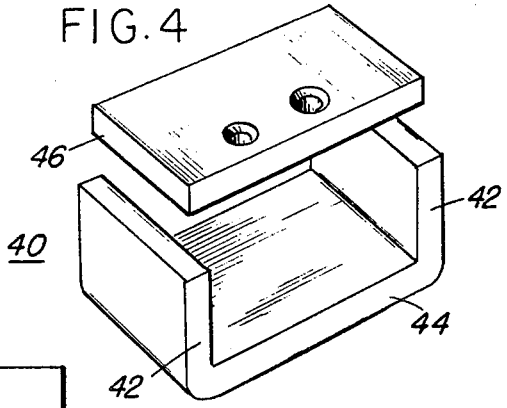
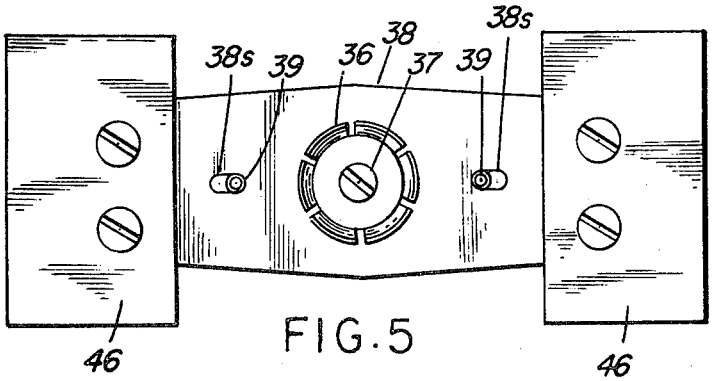
FIG.5
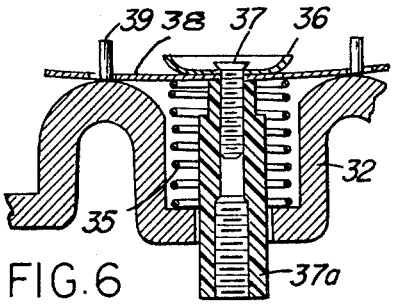
FIG.6

ANTI-ROCK PREVENTING MEANS FOR ELECTRIC SWITCH CONTACTS

This application is a division of application Ser. No. 347,460, filed Apr. 4, 1973, entitled "High Current Switch", patented June 3, 1975, U.S. Pat. No. 3,887,888.

This invention relates to electric switches and more particularly to high current electric switches having full load ratings as high as 600 amperes but which under abnormal conditions, such as short circuit conditions may have to carry as high as 20,000 ampere RMS or even in excess of that.

Switches of the sort to which this invention relates are used in connection with emergency supply equipment and in other usages where under short circuit conditions very high amperages are developed. Currents as high as 5,000 amperes may develop under some short circuit conditions, while under more severe and extraordinary conditions, currents as high as 20,000 amperes or in excess of that may occur.

In prior art devices a pair of fixed contacts were bridged by a movable contact that was held in closed circuit condition by a spring pressure against the movable or bridging contact. Ordinarily, the fixed contact members and the bridging contact members as well as the contact surfaces themselves are massive and are held closed by relatively heavy springs which impose considerable pressure on the bridging contact to hold it in engagement with the fixed contacts.

On the occurence of the short circuit current in the neighborhood of 5,000 amperes RMS, contact pressure of the spring holding the bridging contact in engagement with the movable contact can be overcome by magnetic forces of repulsion developed between the stationary and movable contacts. When the spring bias is overcome, the contacts tend to separate. Contact separation under short circuit conditions always results in arcing. This sometimes has resulted in a violent explosion in instances of a large fault. In less severe cases there may be merely a melting of small amounts of contact material, with the result that when the "short" was cleared, by a fuse or other protective device, the contacts would snap back together and the molten material would cool. This caused very firm welding of the contacts together.

The present invention overcomes the above difficulties by utilization of two mechanisms which work together. In one mechanism the very heavy amperage current flow on short circuits is utilized to hold the contacts together, overcoming the effort of such currents to separate the contacts. The second mechanism is a mechanical arrangement to prevent rocking motion of the contacts in switch-closed position and hence tending to prevent any arcing between the fixed and movable contacts under ordinary or moderately severe short circuit conditions.

According to the present invention, magnetic forces generated by the very large over-current conditions are utilized by the addition of a stationary ferromagnetic member half surrounding the stationary contact and an armature on the movable contact. The attractive forces are generated by the passage of current through what is in effect a single-turn coil which passes through the magnetic structure constituted by the magnet and the armature. The stationary magnetic member and the armature need not touch but they cooperate to form a broken loop which provides a concentrated flux path that is particularly effective under heavy short circuit conditions.

One object of the invention is to provide means associated with the fixed and movable contacts which provide on the one hand forces generated in proportion to the increase of current flow which tend to hold the movable contact in engagement with the fixed contact and on the other hand, to prevent rocking of the movable contact on the fixed contact and hence any tendency toward arcing at the point of contact engagement.

Other objects and advantages of the invention will appear as the invention is described in connection with the accompanying drawing.

In the drawings:

FIG. 1 is a longitudinal section view through a switch embodying the invention with the switch contact in open position.

FIG. 2 is a view similar to FIG. 1 with a part of the switch in longitudinal section but with the contacts in closed circuit position.

FIG. 3 is a transverse section view along line 3—3 of FIG. 2.

FIG. 4 is a perspective view of the new magnet structure which tends to keep the movable and fixed contacts in engagement.

FIG. 5 is a fragmentary plan view of the bridging contact of the structure illustrated in FIGS. 1 and 2 showing the novel anti-rocking spring.

FIG. 6 is a fragmentary view showing in section the mounting of the bridging contact on the operating member.

Referring to the drawings, an insulating base 10 of the elongated rectangular form has an elongated channel shaped recess formed in one face of it for receiving the current carrying parts. In the contral part of the recess, there is an aperture through which passes an electromagnetically operated member for causing the reciprocation of the hereinafter described bridging contact structure. One possible type of operating mechanism is disclosed in the H. E. Schleicher U.S. Pat. No. 2,802,919.

At opposite ends of the base are identical thick fixed-contact-carrying plates 20 of generally rectangular form. On top of each plate 20 lies a heavy duty terminal plate 22 which extends beyond the end of the base and on which may be mounted, if desired, a terminal clamp (not shown) by means of which conductor cables may be connected to the switch. The terminal plates 22 and fixed contact plates 20 may be secured to the base by bolts 24 passing through the base and through the plates with nuts 26 threaded on the protruding ends. On the inner end of the contact supporting plate 20 and on the upper upwardly facing surface thereof are fixed contact blocks or faces 28 which preferably are of silver or other common or suitable contact metal or alloy which may be flat, as illustrated, or curved convexly.

For bridging the contacts 28 a movable contact member is provided which in the higher rated devices preferably has arcuate spaced intermediate portions 32. Extending in opposite directions from the arcuate portions 32 parallel to and over the fixed contact plates 20 are ends 33 on the under and inner surface of which are mounted movable contacts 34. The movable contacts may be buttons, or rectangular plates as shown. The faces of the movable contacts 34 which engage the fixed contacts may be arcuate about a longitudinal axis as shown in FIG. 3.

To bias the movable contacts against the fixed contacts in switch-closed position (FIG. 2), a coiled compression spring 35 is positioned between the two arcuate intermediate parts 32. It presses at one end against the middle of the bridging contact member and at its other end against the middle of a thin rectangular flat resilient plate 38 of spring metal. Plate 38 extends over the arcuate parts 32 and is secured in place by a dish-shaped or concave metal washer 36 and a securing screw 37, which passes through the washer and threads into a tapped hole in a cylindrical connector member 37*a*. Connector 37*a* extends coaxially through the coiled spring 35 and loosely through the center of the bridging contact member and is secured with its lower end abutting a molded insulating member 30 by a screw bolt 37*b*. The bolt 37*b* passes through a central bore in member 30, and into a tapped hole in the lower end of connector 37*a* and thus secures the insulation member 30 to the connector 37*a* so that they act as a unit.

The insulation member 30 may be of any suitable shape or form and may be adapted to be secured to conventional operating mechanism (not shown) such as in electromagnetically actuated mechanism of conventional form or any other operating mechanism. Conventionally, when the electromagnetic or other operating mechanism is energized or operated, the bridging contact assembly will be moved downwardly until the movable contacts 34 engage fixed contacts 28. Further downward movement of operating member 30 will cause spring 35 to be compressed and strongly press the bridging contact member, its contacts 34 maintained firmly biased against the fixed contacts 28.

In this structure, the magnetic forces acting on the bridging contact when an overload due to short circuit conditions occurs, tends to overcome and in extreme cases does overcome the bias of the compression spring 35 and causes the movable contacts to separate from the fixed contacts a distance depending upon the degree of overload or overcurrent. Contact separation under short circuit conditions results routinely in arcing between the movable and fixed contacts. This arcing can cause a violent explosion or merely a melting of the contacts. If the contacts melt on momentary separation incident to the short circuit, the short may be cleared by a fuse or other protective device somewhere in the circuit. If the contacts then snap back together, the molten metal will cool, welding the fixed and movable contacts firmly and permanently together. This can happen in a very small interval of time due on the one hand to the extremely high current flow of the short circuit and on the other hand, due to the quick, almost instantaneous, reaction of the switch biasing spring.

The problem of contact separation on short circuit overload conditions is overcome by the present invention by the provision, adjacent each fixed contact, of metallic U-shaped members, each constituting a field piece or magnet, designated in the drawings generally by the numeral 40. The members 40 are preferably made of material of high magnetic permeability (referred to generically as ferromagnetic material) which will not saturate in the presence of fault currents with the design of air gap present, in order that as currents increase, the magnetic force tending to keep the contacts closed will increase. One suitable material is cold rolled steel, but other materials having high permeability in the area of 8000 gausses, such as iron or other steels may be used. The members 40 each have parallel side plates 42 embracing each of the fixed contact members 20 on opposite sides thereof with a transverse plate portion 44 connecting the side arms 42 and lying under the fixed contact members 20 in recessed portions of the base under the fixed contact members. The magnet members 40 are not rigidly held by the fixed contact members but are permitted to have a slight amount of movement for adjusting themselves to an armature member 46 which cooperates therewith.

The armature 46 also is made of ferromagnetic metal in the form of a flat rectangular plate secured by screws or otherwise on the flat top surface of the extending ends 33 of the bridging contact member. The armature plate extends transversely over the contact members 33 and over the top edges of the side plates 42 of the magnet, as may be seen in FIG. 3. The length of the armature plate preferably equals the overall dimension of the magnet 40 and the armature width preferably equals the width of the magnet arms 42, as may be seen in FIG. 4.

A liner member 45 of U-shape made from thin sheet insulation lies within the magnet 40 under the fixed contact 20 so that the magnet is not in direct electrical contact with the fixed contact member. The height of the side plates 42 is such that when the magnet is assembled as shown in FIG. 3, the top edges of the side plates 42 do not touch the armature when the bridging contact is in switch-closed position as shown in FIG. 3. This spacing ensures engagement of the fixed and movable contacts. As the switch contacts wear away in use, the armature will come closer and closer to the arms of the magnet. When the armature 46 finally engages the magnet arms 42, the switch contacts 28 and 34 will have reached the end of their useful life.

The magnetic attraction of the armature 46 to the magnet 40 is created by the electromagnetic flux around the fixed and movable contact members as current flows through them. The fixed and movable contact members thus act like one turn of an electromagnetic coil. Since the electromagnetic flux around the contacts increases in proportion to the square of the current passing through them, the attractive force exerted on the bridging contact member will become very great under short circuit current conditions, thus preventing the bridging contact member from allowing separation of the movable from the fixed contacts.

Under some short circuit conditions when the electromagnetic forces in the prior art switch devices were insufficient to overcome the bias of the spring 35, the electromagnetic force was nevertheless sufficient to weaken the pressure of the movable contact against the fixed contact. The movable contacts then tended to rock on the fixed contact about an axis extending longitudinally of the switch. When the movable contacts are convexly curved along an axis in that direction, the rocking tendency is enhanced, although the curvature was provided for entirely different reasons, namely, adjustment of the movable contact to the fixed contacts as they engage and for increased pressure between the contacts along the line of engagement. The reason for the rocking is not exactly known and was not noted in prior art devices, but is thought to be caused possibly by variations in the force relationships in the magnetic assembly as the polarity of the alternating current changes. The rocking causes some minor arcing at the contact surfaces. Although the arcing is not as serious as the short circuit arcing, it is desirable to avoid it.

In order to overcome this rocking tendency, the flat leaf spring 38 is provided preferably made in strip form from stiff spring sheet metal. The spring is mounted beneath the convex surface of the washer 36 and extends longitudinally over the bridging contact member and is adapted to press on the outward or top surface of the arcuate portions 32 thereof. The anti-rocking spring 38 is kept in proper longitudinal orientation and from turning about the axis of the securing screw 37 by two pins 39 extending upwardly from a mounting in each of the two portions 32 of the bridging contact member. The pins 39 extend through aligned slots 38s extending longitudinally of the leaf spring 38. The pins 39 are located in the ends of the slots 38s nearest the center of the spring. The slots prevent binding of the spring as the bridging contact between switch-open and switch-closed positions. In switch-open position, the leaf spring 38 is not in engagement with the arcuate portions 32 of the bridging contact member; but upon movement toward switch-closed position, after the movable contacts 34 engage the fixed contacts 28 and the bridging contact member can move no further, the leaf spring is carried into engagement with the parts 32 of the bridging contact member by continued movement in switch-closing direction of all but the bridging member itself. The leaf spring 38 thus becomes slightly stressed and will exert a small amount of pressure or bias of the movable contacts against the fixed contacts. By reason of the spring being flat and engaging the top surface of the parts 32 of the bridging contact member in parallel lines that are coplanar with the plane of the spring 38 (as may be seen in FIG. 3) and the pins 39 engaging with the sides of slots 38*s*, the rocking tendency of the movable contacts 34 on the fixed contacts 28 is overcome.

In addition to the anti-rocking function of the leaf spring 38, this spring prevents contact bounce as tends to occur when one of the movable contacts engages its fixed contact before the other. To that end, location of the pins 39 in the inner ends of slots 38*s* is desired. The slots 38*s* in the leaf spring thus enable lengthwise bowing of the bridging contact member, whilst applying constant pressure along parallel lines at spaced positions along the bridging contact member on opposite sides of the axis of the main biasing spring 35. The operating member 30 has a flat upper or outer end on which rests the middle of the bridging contact member whose lower or inner surface is likewise flat.

Still further there is a tendency of the bridging contact to tilt or teeter longitudinally about the screw 37 and connector member 37*a*. This tilting is restricted by the location of the pins 39 in the proximate ends of the slots 38*s*. The pins engage the spring as the tilting tends to increase. This engagement in cooperation with the engagement of the bridging member with the connector member or port 37*a* restricts the tilting.

From the foregoing, it will be clear that arcing due to contact separation or weakening of the pressure of the movable contacts against the fixed contacts incident to different short circuit conditions is overcome by this invention due on the one hand to utilization of the electromagnetic forces generated during the high current conditions (such as are created by extraordinary short circuiting) to increasingly press the bridging and fixed contacts together, and on the other hand, by using a supplementary leaf spring in cooperation with the bridging contact member to prevent rocking of the movable contacts on the fixed contacts under lesser short circuit conditions.

Many modifications within the scope of the invention will occur to those skilled in the art. Therefore, the invention is not limited to the specific form and dimensions of the invention as described in the preferred embodiment illustrated.

We claim:

1. An electric switch comprising a pair of fixed contact members and a bridging contact member movable into and out of engagement with said fixed contact members, operating means carrying said bridging contact member, and anti-rocking means loosely carried by said operating means and engaging said bridging contact member at spaced positions defining a plane in switch-closed position and exerting an anti-rocking force on said bridging contact member to prevent rocking of the contacting surfaces of said bridging member on the contacting surfaces of said fixed contact members in switch-closed position on a short circuit condition.

2. An electric switch comprising a pair of fixed contact members and a bridging contact member movable into and out of engagement with said fixed contact members, operating means carrying said bridging contact member, and a leaf spring carried by said operating means and engaging said bridging contact member in switch closed position at spaced locations along parallel lines transverse to the length of the bridging contact member and exerting an anti-rocking force on said bridging contact member to prevent rocking of the contacting surfaces of said bridging member on the contacting surfaces of said fixed contact members in switch-closed position on a short circuit condition.

3. An electric switch as claimed in claim 2 wherein said spring has slots running along its length, and pins mounted in said bridging member extending through said slots at their adjacent ends.

* * * * *